US011375760B2

(12) United States Patent
Rutten et al.

(10) Patent No.: US 11,375,760 B2
(45) Date of Patent: Jul. 5, 2022

(54) SAFETY GARMENT SYSTEM

(71) Applicants: Michael William Rutten, Sherwood Park (CA); Kristofer Jermey McLeod, Sherwood Park (CA)

(72) Inventors: Michael William Rutten, Sherwood Park (CA); Kristofer Jermey McLeod, Sherwood Park (CA)

( * ) Notice: Subject to any disclaimer, the term of this patent is extended or adjusted under 35 U.S.C. 154(b) by 148 days.

(21) Appl. No.: 17/022,688

(22) Filed: Sep. 16, 2020

(65) Prior Publication Data

US 2021/0000192 A1 Jan. 7, 2021

Related U.S. Application Data

(63) Continuation-in-part of application No. 15/983,084, filed on May 17, 2018, now abandoned.

(51) Int. Cl.
*A41D 13/00* (2006.01)

(52) U.S. Cl.
CPC ..... *A41D 13/0007* (2013.01)

(58) Field of Classification Search
CPC ..... A41D 13/0007; A62B 35/0025
See application file for complete search history.

(56) References Cited

U.S. PATENT DOCUMENTS 7,707,660 B2 * 5/2010 Grilliot ..... A41D 13/0007 2/93
7,818,818 B2 * 10/2010 Grilliot ..... A41D 13/0007 2/329
8,651,234 B2 * 2/2014 Yocco ..... A62B 35/0018 182/3
8,656,516 B1 * 2/2014 Reinhardt Rawlings ..... A41D 11/00 2/69
2008/0289089 A1 * 11/2008 Grilliot ..... A62B 17/006 2/458

* cited by examiner

*Primary Examiner* — Katherine M Moran
(74) *Attorney, Agent, or Firm* — Argus Intellectual Enterprise; Daniel Enea; Jordan Sworen

(57) ABSTRACT

A safety garment system including a garment having an interior side, an exterior side, a harness, a first handle, and a second handle. The harness is configured on the interior side of the garment. The first handle and the second handle are configured on the exterior side and are positioned on opposing sides at a shoulder portion of the garment. The garment can be used to safely drag a wearer to safety in an emergency using the harness, the first handle, and the second handle.

14 Claims, 5 Drawing Sheets

SAFETY GARMENT SYSTEM

CROSS REFERENCE TO RELATED APPLICATION

This application claims the benefit of U.S. Nonprovisional application Ser. No. 15/983,084 filed on May 17, 2018, now abandoned. The above identified patent application is herein incorporated by reference in its entirety to provide continuity of disclosure.

BACKGROUND OF THE INVENTION

The present invention relates generally to the field of safety garments and more specifically relates to coveralls.

Oil and gas well drilling and oil and gas well servicing involve many different types of equipment and materials. Workers in the oil and gas industries face the risk of fire and explosion due to ignition of flammable vapors or gases, along with other risks. Flammable gases, such as well gases, vapors, and hydrogen sulfide, can be released from wells, trucks, production equipment or surface equipment. When an injured person is down, another person willing to save his life will be putting substantially more risk on their own life. Current methods are unsafe for both parties involved. For example, in an emergency situation a rescuer may have to pull on any loose article of clothing of victim in an effort to move from an unsafe situation However, the article of clothing may tear slowing evacuation from the dangerous situation. For a victim it is imperative to get to a fresh air environment as quickly as possible. A suitable and more efficient means for rescuing is desired.

The present invention is adapted to provide a wearable safety garment system that appears as a typical work uniform, while having an integrated harness system. The harness system is positioned on an interior side of the garment and operably connected to a first handle and a second handle each disposed on a respective shoulder portions of the garment. The harness system includes a shoulder harness, a front torso harness, and a groin harness. These harnesses cooperatively allow a rescuer to pull the wearer at the handles without risk of the garment tearing or otherwise being ineffective in dragging the wearer from a dangerous situation.

In light of the devices disclosed in the known art, it is submitted that the present invention substantially diverges in design elements and methods from the known art and consequently it is clear that there is a need in the art for an improvement for safety garment systems. In this regard the instant invention substantially fulfills these needs.

SUMMARY OF THE INVENTION

In view of the foregoing disadvantages inherent in the known types of safety garment systems now present in the known art, the present invention provides a wearable safety garment system that appears as a typical work uniform, while having an integrated harness system.

The safety garment system includes a garment having an interior side, an exterior side, a harness, a first handle, and a second handle. The garment is defined by a body having the interior side and the exterior side. The harness system is positioned on an interior side of the garment and operably connected to a first handle and a second handle each disposed on a respective shoulder portion of the garment. The harness system allows a rescuer to pull the wearer at the handles without risk of the garment tearing or otherwise being ineffective in dragging the wearer from a dangerous situation. A pair of patches are removably secured to the first handle and the second handle such that each patch conceals the first handle and the second handle, respectively. Moreover, the shoulder harness is distinct and independent from the front torso harness, such that a size adjustment of either the shoulder harness or the front torso harness does not affect a size adjustment of the other. In this way, pulling of the handle does not cause movement of the harness that is affixed to the garment.

It is an object of the present invention to provide a garment safety system having a harness system integrated with the garment, wherein the harness system is operably connected to a first handle and a second handle each disposed on a respective shoulder portion of the garment.

Another object of the present invention is to provide a garment safety system with a harness system having a shoulder harness, a front torso harness, and a groin harness. The harness system provides secure attachment to the garment, such that pulling of the handles by a rescuer applies a distributed force to the harness system. Thereby, effectively pulling the wearer from a dangerous situation and not causing injury to the wearer during the rescuing act.

It is yet another objective of the present invention to provide a garment safety system having a pair of patches removably secured to the first handle and the second handle, each patch configured to conceal the first handle and the second handle, respectively. The pair of patches comprise a patch fastener configured to mate with a garment fastener located on the garment and the pair of patches are completely removeable from the garment for use of the first handle and the second handle.

It is an object of the present invention to provide a garment safety system wherein the shoulder harness is distinct and independent from the front torso harness, such that a size adjustment of either the shoulder harness or the front torso harness does not affect a size adjustment of the other.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Reference is made herein to the attached drawings.

For the purposes of presenting a brief and clear description of the present invention, the preferred embodiment will be discussed as used for providing a wearable safety garment system that appears as a typical work uniform, while having an integrated harness system. The figures are intended for representative purposes only and should not be considered to be limiting in any respect.

Reference will now be made in detail to the exemplary embodiment (s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment", "first embodiment", "second embodiment", or "third embodiment" does not necessarily refer to the same embodiment.

Figure 1:
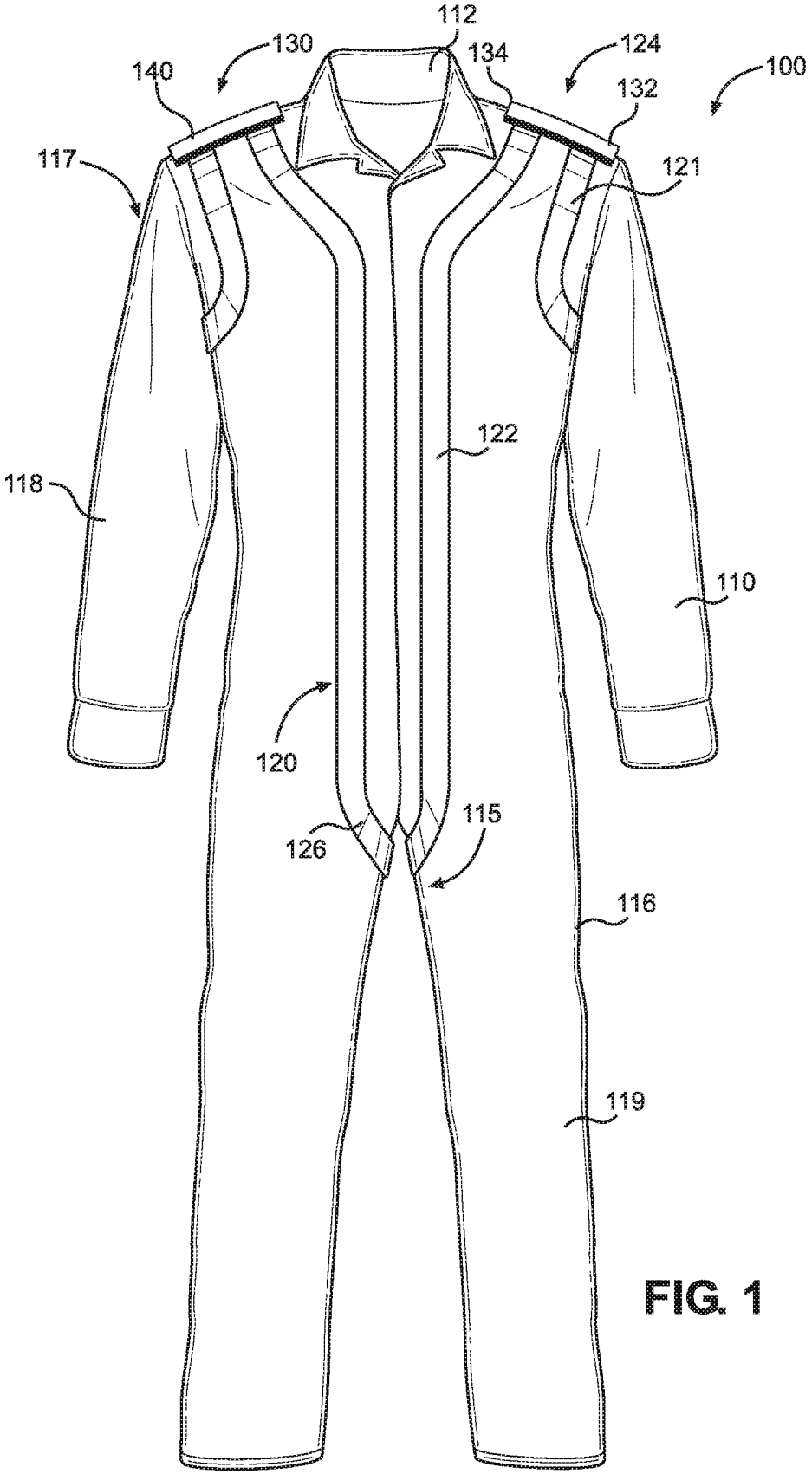
FIG. 1 shows a perspective view of a front side of an embodiment of the safety garment system.
Figure 2:
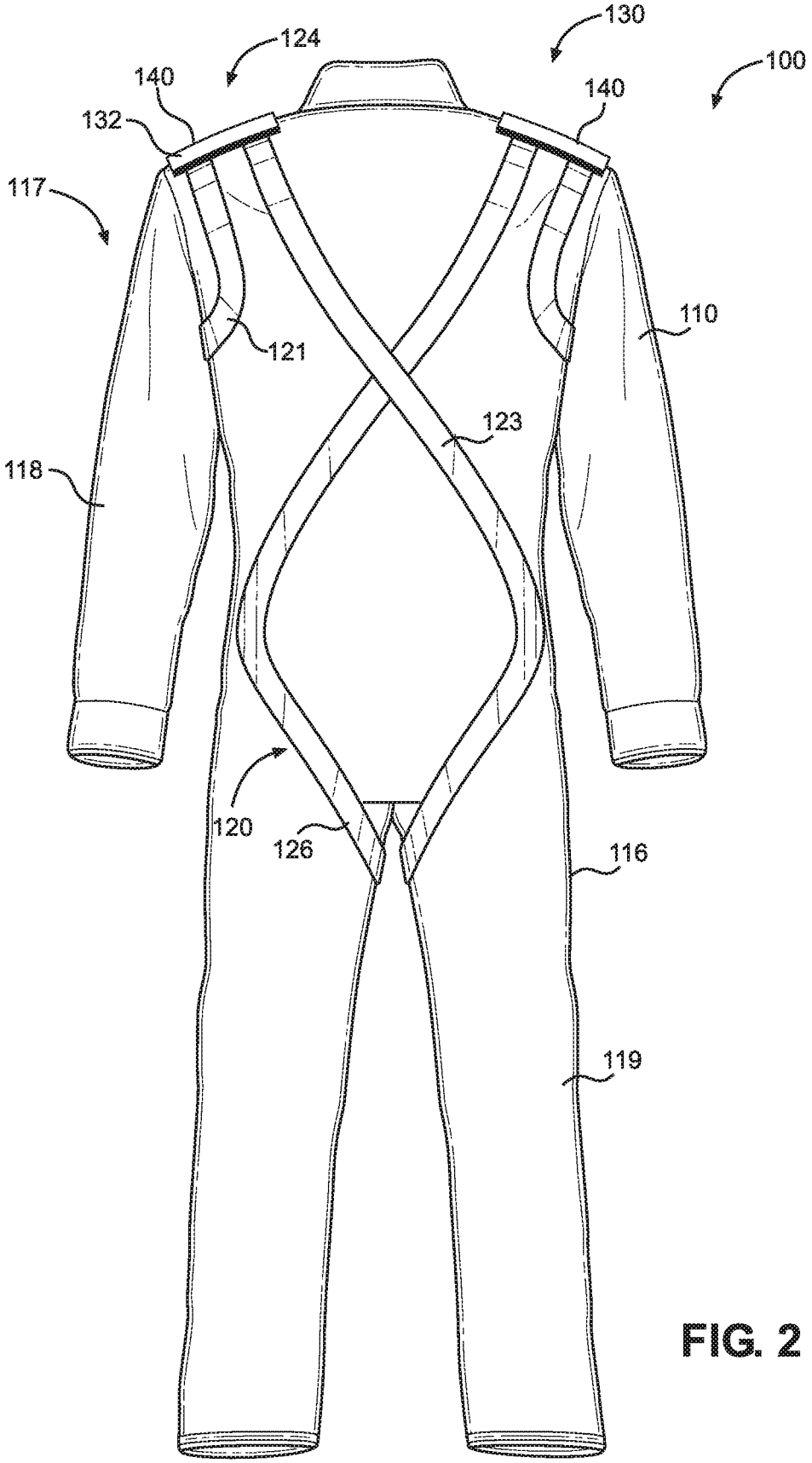
FIG. 2 shows a perspective view of a rear side of an embodiment of the safety garment system.

Referring now to FIGS. 1 and 2, there is shown a perspective view of a front and rear side of an embodiment of the safety garment system, respectively. The safety garment system 100 comprises a garment 110 having an interior side 112, an exterior side 116, a harness or harness system 120, a first handle 124, and a second handle 130. In the illustrated embodiment, the garment 110 is defined by a body having the interior side 112 and the exterior side 116. In the shown embodiment, the harness system 120 is disposed on an interior side 112 thereof and operably connected to a first handle 124 and a second handle 130 each disposed on a respective shoulder portion 117 of the garment 110. The first handle 124 and the second handle 130 are configured on the exterior side 116 and are positioned on opposing sides (left and right) at a shoulder portion 117 of the garment 110. The garment 110 is configured to be used to drag a victim to safety using the harness 120, the first handle 124, and the second handle 130. More handles may be used in alternate embodiments.

Referring to FIG. 2, the safety garment system 100 includes the garment 110 which may be used for effectively dragging a victim in a life-threatening environment. In one embodiment, the garment 110 is a pair coveralls. The garment 110 may be provided in a summer or winter design for around the year use. The garment 110 further includes a pair of patches 140 configured to be secured on top of both the first handle 124 and the second handle 130 and conceal the first handle 124 and the second handle 130. In the shown embodiment, the pair of patches 140 are each substantially rectangular. The pair of patches 140 comprise a patch fastener 142 (see FIG. 3) which is configured to mate with a garment fastener 144 located on the garment 110. The patch fastener 142 and the garment fastener 144 include hook-and-loop fasteners, snap fasteners, or other suitable fastening means. In the shown embodiments of FIGS. 3 and 4, the garment fastener 144 is positioned around a perimeter of the first handle 124 and the second handle 130 and is configured to receive the patch fastener 142. In alternative embodiments, the patch and garment fasteners 142, 144 may have any shape and configuration for semi-permanently securing the patch 140 to the garment 110. The patches maintain the handles in a stored configuration and prevent the handles from being accessed, thereby preventing the handle from becoming caught or ensnared on an object when not in use.

In the shown embodiment, the harness system 120 comprises a shoulder harness 121 encircling an arm portion 118 of the garment 110, wherein the shoulder harness 121 is coupled to a lateral end 132 of each the first handle and the second handle 124, 130, respectively. In this way, the shoulder harness 121 is adapted to receive the arm of the wearer therethrough. A front torso harness 122 extends between a groin harness 126 and a medial end 134 of each of the first handle and the second handle 124, 130, respectively. As shown, the groin harness 126 extends between the front torso harness 122 and a groin portion 115 of the garment, wherein the groin harness 126 encircles a leg portion 119 of the garment to provide strength to the garment 110 allowing a rescuer to drag the wearer.

In the shown embodiment, the first handle and the second handle 124, 130 are each permanently configured on an exterior side 116 of the garment 110, such that each handle 124, 130 are adapted to provide a gripping portion in operation.

In one embodiment, the shoulder harness 121 is distinct and independent from the front torso harness 122, such that a size adjustment of either the shoulder harness 121 or the front torso harness 122 does not affect a size adjustment of the other. In this way, as the rescuer pulls the handles 124, 130 so as to drag the wearer of the garment safety system 100, the shoulder harness 121 and/or the front torso harness 122 remains affixed to the garment 110. In this way, the pulling force of the rescuer occurs at the shoulder portions 117 and is evenly distributed throughout the garment 110. In one embodiment, the front torso harness 122, the rear torso harness 123, the shoulder harness 121, and the groin harness 126 are permanently affixed to the garment. In one embodiment, the harness 110 is stitched to the interior side 112 of the garment.

Figure 3:
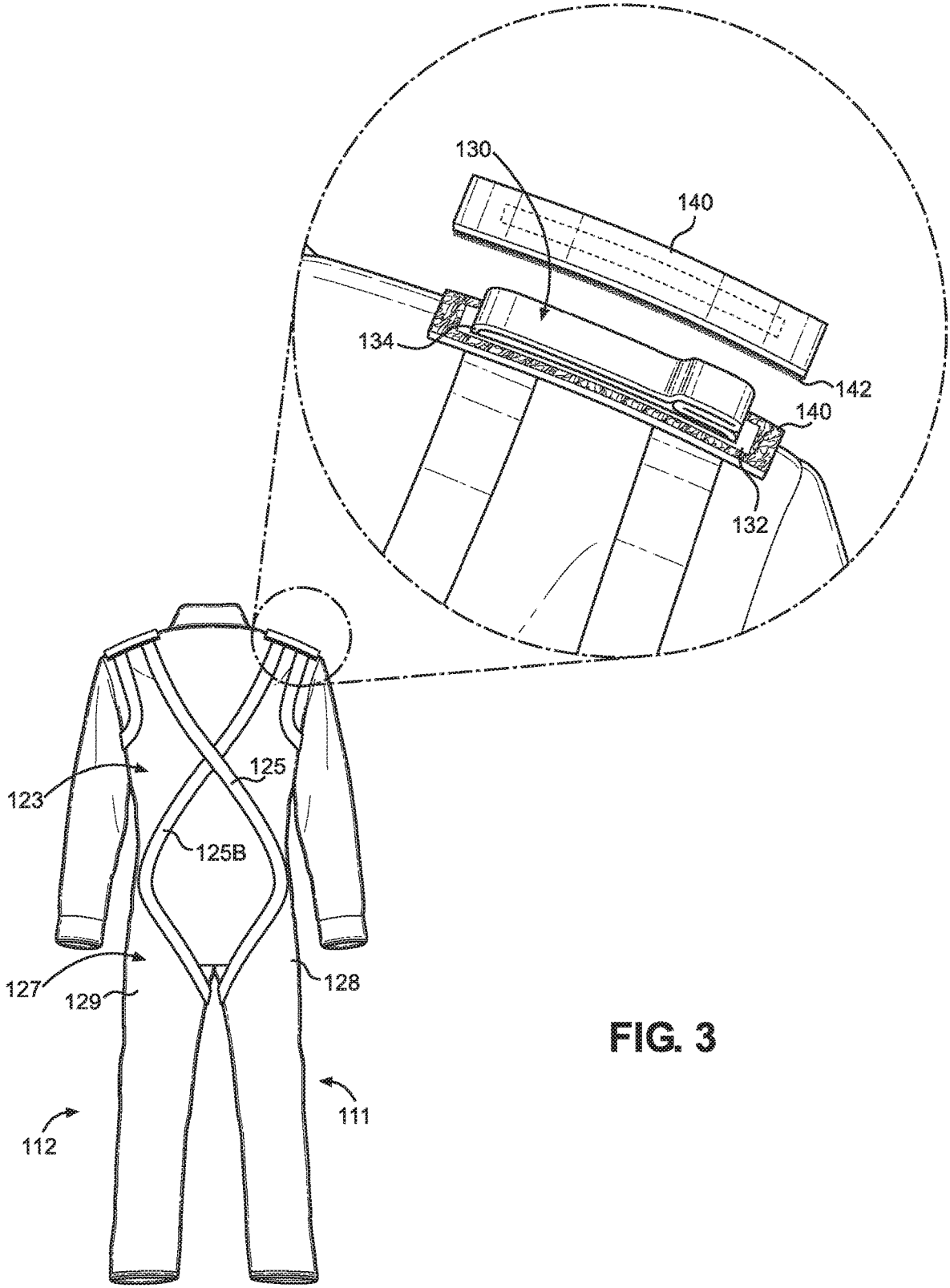
FIG. 3 shows a close-up view of the handle of an embodiment of the safety garment system.
Figure 5:
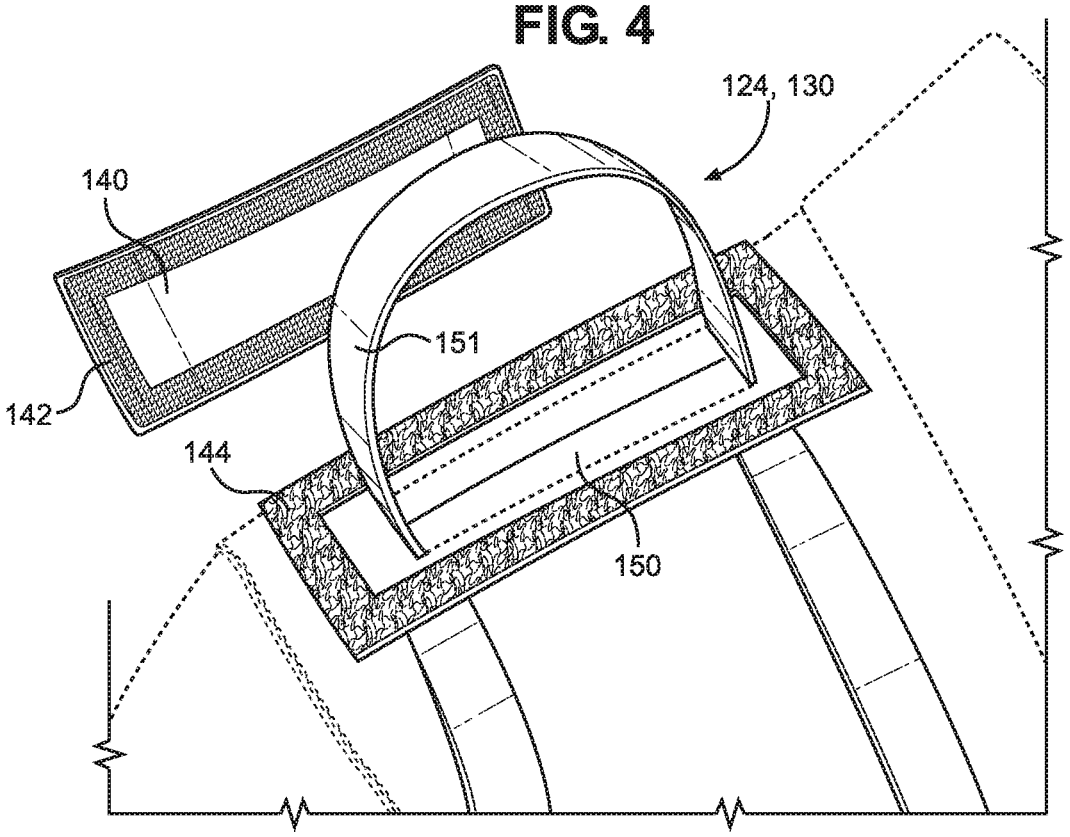
FIG. 5 shows a perspective view of the shoulder portion of an embodiment of the safety garment system with patch removed.

Referring now to FIG. 3, there is shown a close-up view of the handle of an embodiment of the safety garment system. In one embodiment, the first handle 124 and the second handle 130 are configured to fold under the patch 140. The first handle 124 and the second handle 130 are substantially flat on top of a shoulder during non-use. In the shown embodiment, the handles 124, 130 comprise a strap having an arc length extending between a lateral end 132 and a medial end 134 of each handle 124, 130. The lateral end 132 of the handles 124, 130 is the outer side or distal side thereof. The medial ends 134 of the handles 124, 130 are towards the middle of the garment. The arc length of the handles 124, 130 is greater than a linear length between the lateral end 132 and medial ends 134 (as shown in FIG. 5). In this way, for the handle 124, 130 to lay flat on the shoulder portion 117, the handles 124, 130 are folded onto itself. Therefore, when the patch 140 is secured to the garment 110, the handles 124, 130 lay substantially flat thereunder.

In one embodiment, the pair of patches 140 comprise a material which is the same or similar to that of the garment 110. The pair of patches 140 are removeable from the garment 110 for use of the first handle 124 and the second handle 130. The patches 140 protect the first handle 124 and the second handle 130 from flash fires and potential snags.

In the shown embodiment, the harness system 120 further comprises a rear torso harness 123 comprising a first strap 125 and a second strap 125B. The first strap 125 extends from a waist portion 127 between a first side 128 of a waist portion of the garment 110 and the first handle 124 disposed on a second side 112 of the garment. The second strap 125B extends between a second side 129 of the waist portion of the garment and the second handle 130 disposed on a first side 111 of the garment. The first side 111 of the garment and the second side 112 of the garment are disposed on left and right sides of the garment, respectively. In the illustrated embodiment, the groin harness terminates at a waist portion of the rear side.

Figure 4:
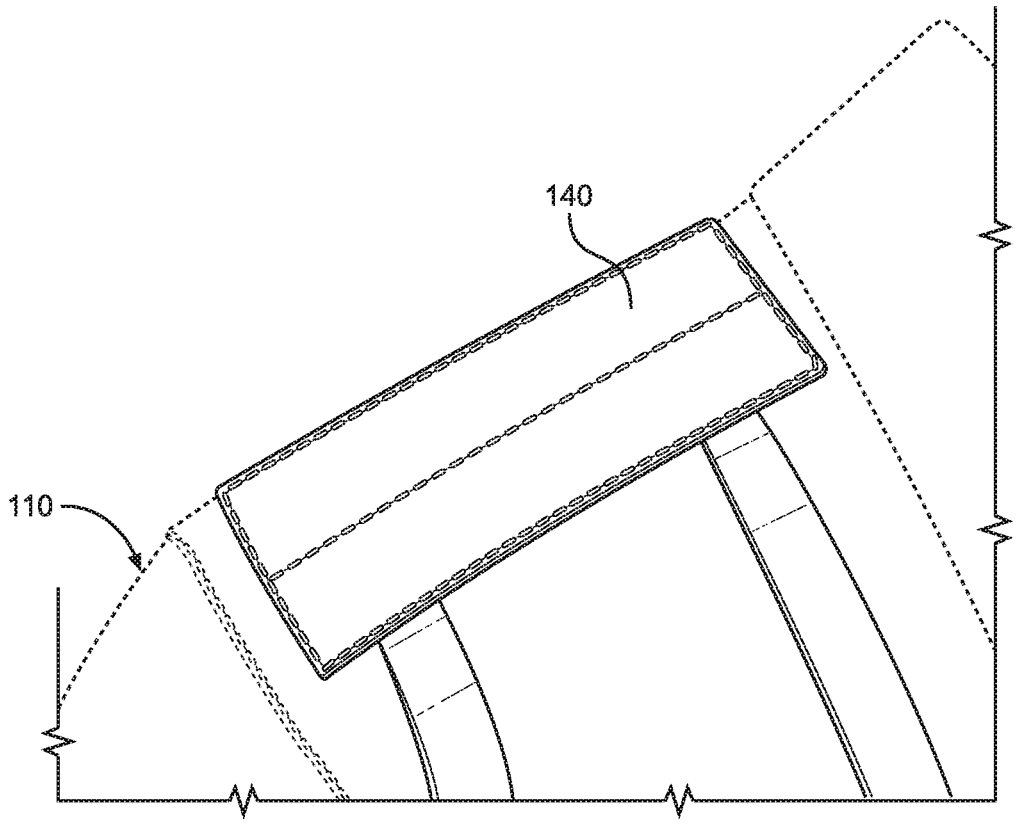
FIG. 4 shows a perspective view of the shoulder portion of an embodiment of the safety garment system with patch attached.

Referring now to FIGS. 4 and 5, there is shown a perspective view of the shoulder portion of an embodiment of the safety garment system with patch attached and removed, respectively. In the shown embodiment, a pair of patches 140 are each configured to be removably secured to the first handle 124 and the second handle 130, such that each patch 140 is configured to conceal the first handle and the second handle, respectively. The pair of patches 140 comprise a patch fastener 142 configured to mate with a garment fastener 144 located on the garment 110. The pair of patches 140 are completely removeable from the garment 110 for use of the first handle and the second handle 124, 130.

In the shown embodiment, the harness 120 is connected to the first handle 124 and the second handle 130. The first handle 124 and the second handle 130 each comprise the shoulder strap 150 and handle strap 151 include an opening suitable for receiving a hand for dragging the victim to safety using the first handle 124 and the second handle 130. The first handle 124 and the second handle 130 each comprise a length of flexible material.

In one embodiment, the harness 120 is lightweight and is configured to support a weight of the victim. The safety garment system 100 allows a rescuer to drag another person (wearer) to a fresh air environment in a safe and timely manner. The rescuer is able to drag the wearer while walking forward in an upright position, unlike other current methods. The person will have total control of the victim and be able to easily get the person out of a ditch or up/down a set of stairs, when gripping and using the first handle 124 and the second handle 130. The coveralls will naturally cradle the victim's neck and head.

Figure 6:
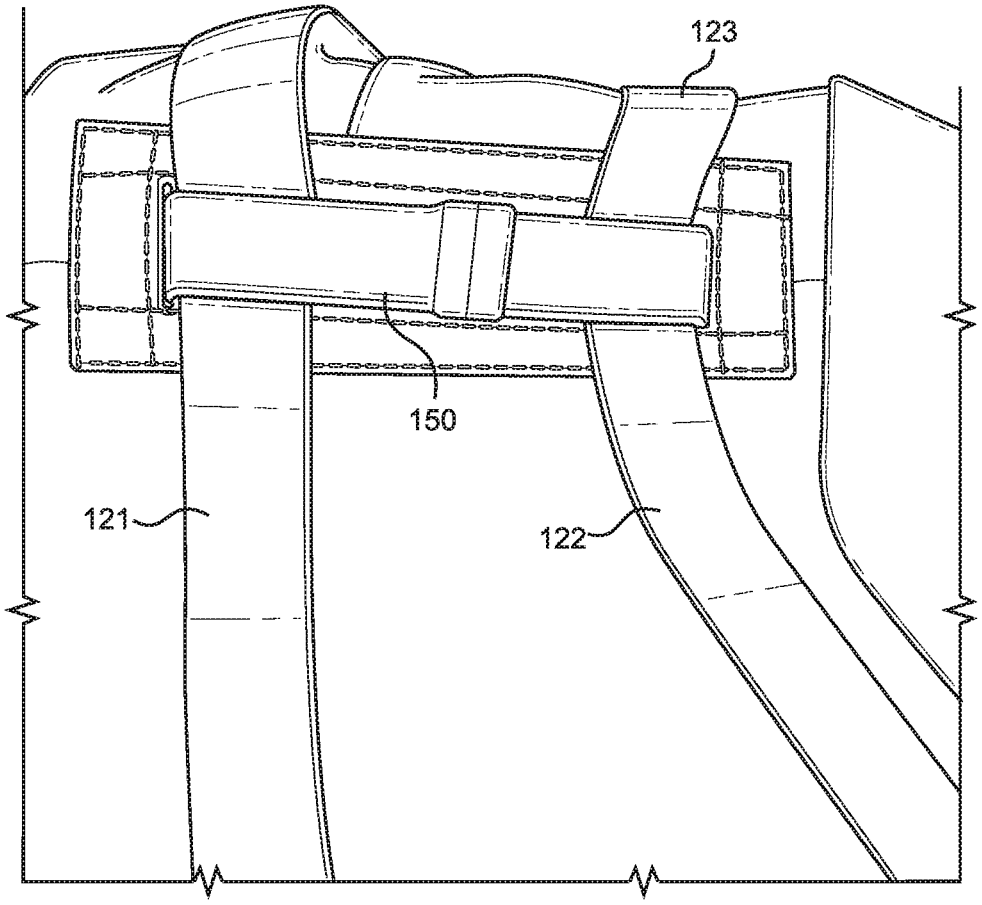
FIG. 6 shows a perspective view of an interior side of the shoulder portion of an embodiment of thee safety garments system.

Referring now to FIG. 6, there is shown a perspective view of an interior side of the shoulder portion of an embodiment of thee safety garments system. In the shown embodiment, the shoulder harness 121 and the front and rear torso harnesses 122, 123 are fixed to a shoulder strap 150. The shoulder strap 150 is sewn directly to the harness 121, 122, 123, such that the shoulder strap 150 remains fixed in position relative to the garment and the harnesses 121, 122, 123.

In the shown embodiment, the first and second handle 124, 130 each comprise the shoulder strap 150 and handle strap 151, wherein the shoulder strap 150 is directly affixed to the shoulder harness 121 and the front torso harness 122, wherein the handle strap 151 is directly affixed to the shoulder strap 150. The shoulder strap and handle strap 150, 151 form an opening suitable for receiving a hand for dragging a victim to safety, wherein the handle strap 151 a fixed length. The harness 120 is approximately 1-inch wide.

Since the handles 124, 130 are directly secured to the harness and the harness is affixed entirely to the interior side of the garment, the harness system is adapted to not tension when the pair of patches fastened to the first handle and the second handle, respectively, is uncoupled therefrom. Moreover, when the handles 124, 130 are pulled by a rescuer the harness system is adapted to remain affixed to the garment throughout the entire interior side of the garment. In this way, the handle 124, 130 position is independent of the position of the harness system 120.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A safety garment system comprising:

a garment having a harness system disposed on an interior side thereof and operably connected to a first handle and a second handle each disposed on a respective shoulder portion of the garment;

the harness system comprising:

a shoulder harness encircling an arm portion of the garment, wherein the shoulder harness is coupled to a lateral end of each the first handle and the second handle, respectively;

a front torso harness extending between a groin harness and a medial end of each of the first handle and the second handle, respectively;

the groin harness extending between the front torso harness and a groin portion of the garment, wherein the groin harness encircles a leg portion of the garment;

wherein the shoulder harness is distinct and independent from the front torso harness, such that a size adjustment of either the shoulder harness or the front torso harness does not affect a size adjustment of the other;

wherein the first handle and the second handle are each permanently configured on an exterior side of the garment, each handle adapted to provide a gripping portion in operation.

2. The safety garment system of claim 1, wherein the harness system further comprises a rear torso harness comprising a first strap and a second strap, the first strap extending between a first side of a waist portion of the garment and the first handle disposed on a second side of the garment, the second strap extending between a second side of the waist portion of the garment and the second handle disposed on a first side of the garment, wherein the first side of the garment and the second side of the garment are disposed on left and right sides of the garment, respectively.

3. The safety garment system of claim 1, wherein the garment further comprises:

a pair of patches configured to be removably secured to the first handle and the second handle, each patch configured to conceal the first handle and the second handle, respectively;

wherein the pair of patches comprise a patch fastener configured to mate with a garment fastener located on the garment; wherein the pair of patches are completely removeable from the garment for use of the first handle and the second handle.

4. The safety garment system of claim 3, wherein the patch fastener and the garment fastener include hook-and-loop fasteners.

5. The safety garment system of claim 3, wherein the patch fastener and the garment fastener include snap fasteners.

6. The safety garment system of claim 3, wherein the garment fastener is configured around a perimeter of the first handle and the second handle and is configured to receive the patch fastener.

7. The safety garment system of claim 3, wherein the pair of patches are each substantially rectangular.

8. The safety garment system of claim 3, wherein the harness system is adapted to prevent tensioning of the harness when the pair of patches fastened to the first handle and the second handle respectively, is uncoupled therefrom.

9. The safety garment system of claim 1, wherein the first handle and the second handle include an opening suitable for receiving a hand for dragging a victim to safety using the first handle and the second handle.

10. The safety garment system of claim 1, wherein the first handle and the second handle each comprise a length of flexible material.

11. The safety garment system of claim 1, wherein the harness system is integral to the garment.

12. The safety garment system of claim 1, wherein the harness system is configured to support a weight of a victim.

13. The safety garment system of claim 1, wherein the harness system is approximately 1-inch wide.

14. The safety garment system of claim 1, wherein the first and second handle each comprise a shoulder strap and handle strap, wherein the shoulder strap is directly affixed to the shoulder harness and the front torso harness, wherein the handle strap is directly affixed to the shoulder strap, wherein the shoulder strap and handle strap form an opening suitable for receiving a hand for dragging a victim to safety, wherein the handle strap has a fixed length.

* * * * *